US005607151A

United States Patent [19]

Daley

[11] Patent Number: 5,607,151

[45] Date of Patent: Mar. 4, 1997

[54] TABLE TENNIS BALL PROJECTOR

[76] Inventor: Westphal Daley, 68 Simpson St., Hartford, Conn. 06112

[21] Appl. No.: 636,902

[22] Filed: Apr. 1, 1996

[51] Int. Cl.[6] ..... F41B 15/00

[52] U.S. Cl. ..... 124/78

[58] Field of Search ..... 273/26 D, 29 A; 124/78

[56] References Cited

U.S. PATENT DOCUMENTS

| | | | |
|---|---|---|---|
| 3,604,409 | 9/1971 | Doeg | 273/26 D |
| 3,724,437 | 4/1973 | Halstead | 273/26 D |
| 4,712,534 | 12/1987 | Nozato | 273/26 D |
| 5,046,476 | 9/1991 | Nozato | 273/26 D |
| 5,125,653 | 6/1992 | Kovacs | 273/26 D |
| 5,437,261 | 8/1995 | Paulson | 273/26 D |

*Primary Examiner*—Theatrice Brown

[57] ABSTRACT

A table tennis ball projecting apparatus which can be used as the ball propelling mechanism of a table tennis robot. Its construction is such that balls entering its entrance port sequentially, will be ejected by a motor rotated rubber-rimmed thrust wheel. Two smaller rubber-rimmed wheels each on its own smaller motor, provide clockwise or counterclockwise spin on the ejected ball. The lighter spin-producing wheels and motors facilitate the production of rapid spin direction and magnitude changes on consecutively ejected balls thereby closely simulating practice between two humans.

2 Claims, 6 Drawing Sheets

TABLE TENNIS BALL PROJECTOR

BACKGROUND OF THE INVENTION

This invention is related to devices or robots used for practice in sports such as baseball, tennis and table tennis. More specifically, it relates to table tennis robots that employ motor-rotated wheels to engage a ball, thereby providing the thrust required for projecting the ball. The invention is intended to be adapted as the throwing mechanism or head for a table tennis robot.

In general, robots employ rotating wheels to engage the ball while simultaneously pressing it against another rotating wheel or fixed surface, thereby rolling and projecting the ball into open space. A single rotating wheel may be used, in which case, the ejected ball always carries spin, or, two rotating wheels may be employed, in which case, the ball can be ejected with spins or no spin.

When two wheels are used, a ball without spin is possible when both wheels rotate in opposite directions at the same speed and engage the ball between their peripheries. If only one wheel rotates to throw the ball, then clockwise spin for example, is on the ejected ball. If only the other wheel rotates then counterclockwise spin is produced. The magnitude of the spin on an ejected ball is proportional to the speed at which the ball is ejected.

The mass of the wheels and moving parts of the motors in a ball-throwing mechanism, limits the rate at which the motors can speed up or slow down. This is due to the inertia of these components. In practice, motors and wheels found suitable for throwing balls, require several seconds to rotate from zero RPM to their maximum speed. Conversely, they require approximately the same time to return to zero RPM. Inertia is therefore a limiting factor when the motors must be sped up or slowed down.

When experienced players play table tennis, they often execute two or more strokes each second. Moreover, they can change the magnitude and direction of rotation of the ball on successive strokes. Sometimes the ball rotates in excess of 4000 RPM The inertia of the rotating parts on the head of earlier robots negates their capacity to closely simulate the practice between two players, since reversal of wheel rotation and hence spin, requires too much time.

This invention overcomes the limitation of being unable to reverse the spin on balls successively projected by a single-head robot, when the rate of succession is less than one second. This is possible because in this invention, the ball is ejected by a single rotating wheel which does not impart any required spin to the ball. Spin is developed by separate motors and wheels which are low in mass and are therefore inherently low in inertia. Spin is therefore independent of the speed at which a ball is ejected and can be rapidly reversed without affecting such speed. The result is a table tennis ball projecting mechanism which simulates practice with a human opponent more closely than earlier devices could.

Prior Art to which this invention is related are; (1) U.S. Pat. No. 4,086,903 by Jack C. Scott (2) U.S. Pat. No. 4,325,351 by Yuasa (3) U.S. Pat. No. 3,913,552 by Yarur et al (4) U.S. Pat. No. 3,777,732 by Halloway et al (5) U.S. Pat. No. 3,794,011 by Newgarden (6) U.S. Pat. No. 4,559,918 by Ballerin et at.

SUMMARY OF THE INVENTION

A ball entering its entrance port is carried at high speed by a motor rotated thrust wheel. The ball is soon released by the thrust wheel and is stopped within the mechanism. The stopped ball is then carried slowly and parked in a detented position where it may be rotated in either of two directions by either of two smaller, lighter motors and wheels. The detented ball may receive fast clockwise or counterclockwise spin, or, it may receive slow spin in these directions. It may also receive no spin. Another ball entering the entrance port is also carried at high speed by the thrust wheel. The detent position of the first ball is such that the second ball is able to impact it while the second ball is being carried by the thrust wheel. The result is that the first ball is ejected from the mechanism. The ejected ball carries whatever spin it acquired from the smaller, lighter wheels at the time of impact. The second ball ejects the first ball, the second ball is then detented. The third ball ejects the second and so on.

An electronic system powers the motors and provide automatically randomized spin and speed control.

DETAILED DESCRIPTION

Figure 1:
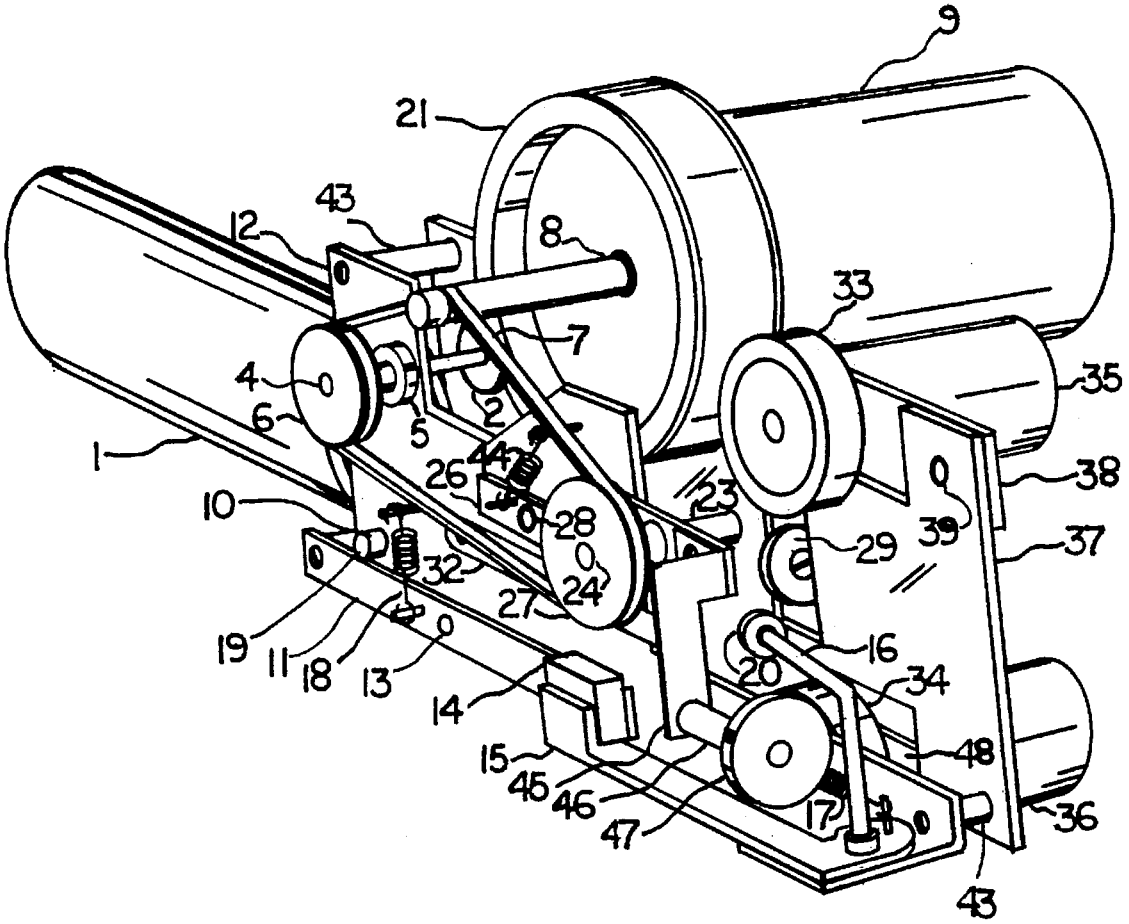
FIG. 1 is a perspective view of the apparatus.
Figure 4:
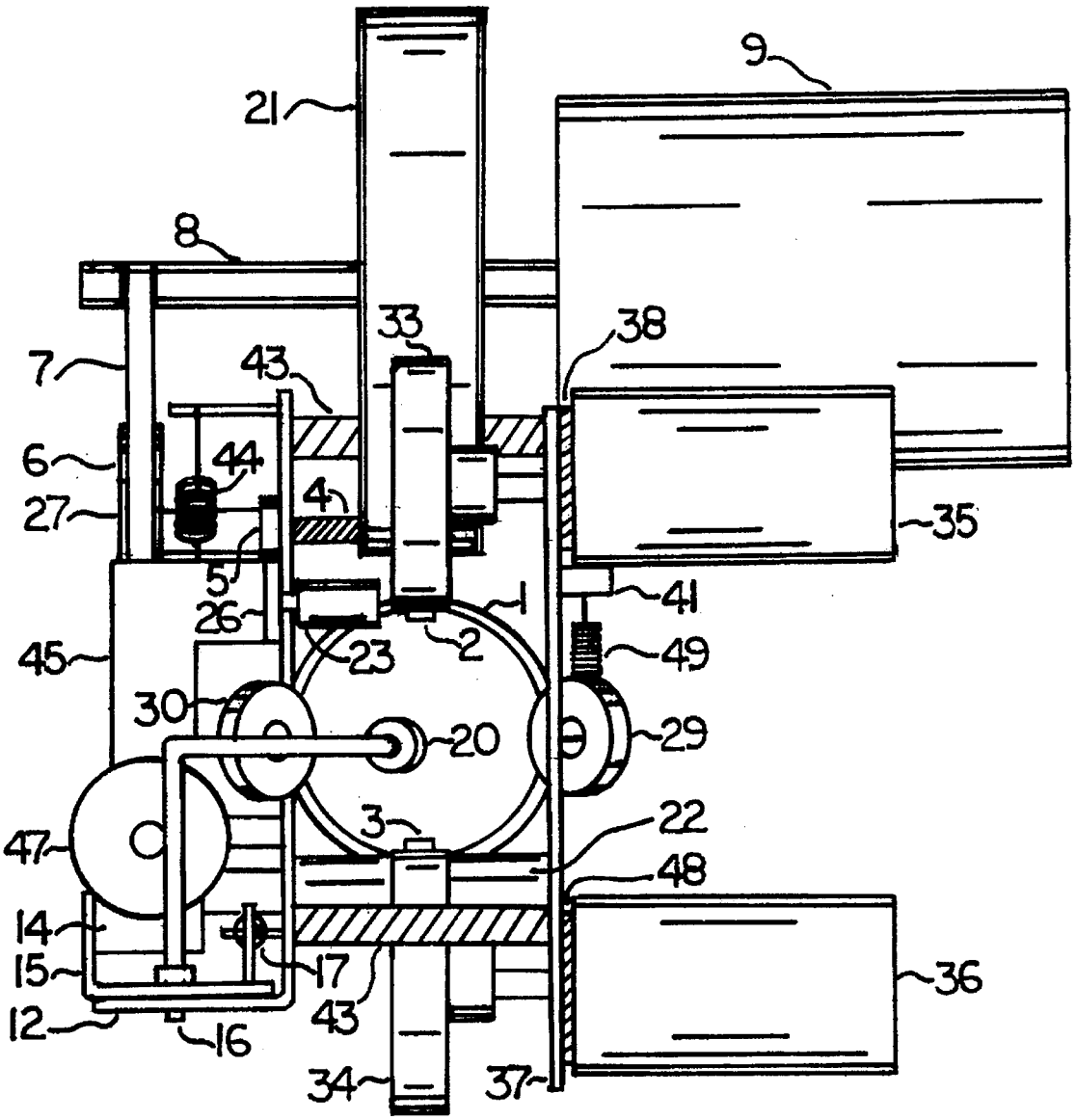
FIG. 4 is an end view of the apparatus looking toward the right end of FIG. 1 from the right.
Figure 5:
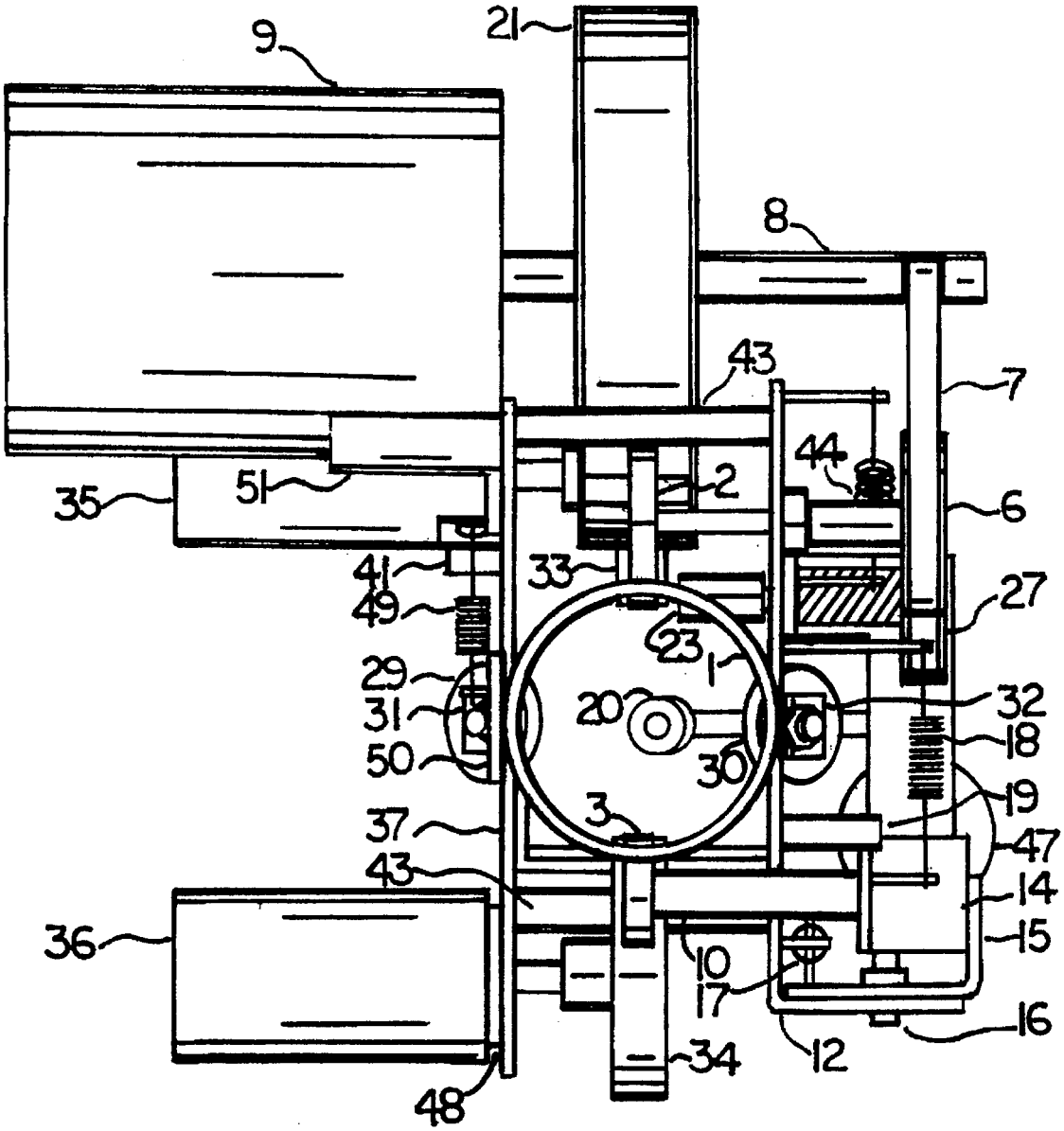
FIG. 5 is an end view of the apparatus looking toward the left end of FIG. 1 from the left.
Figure 6:
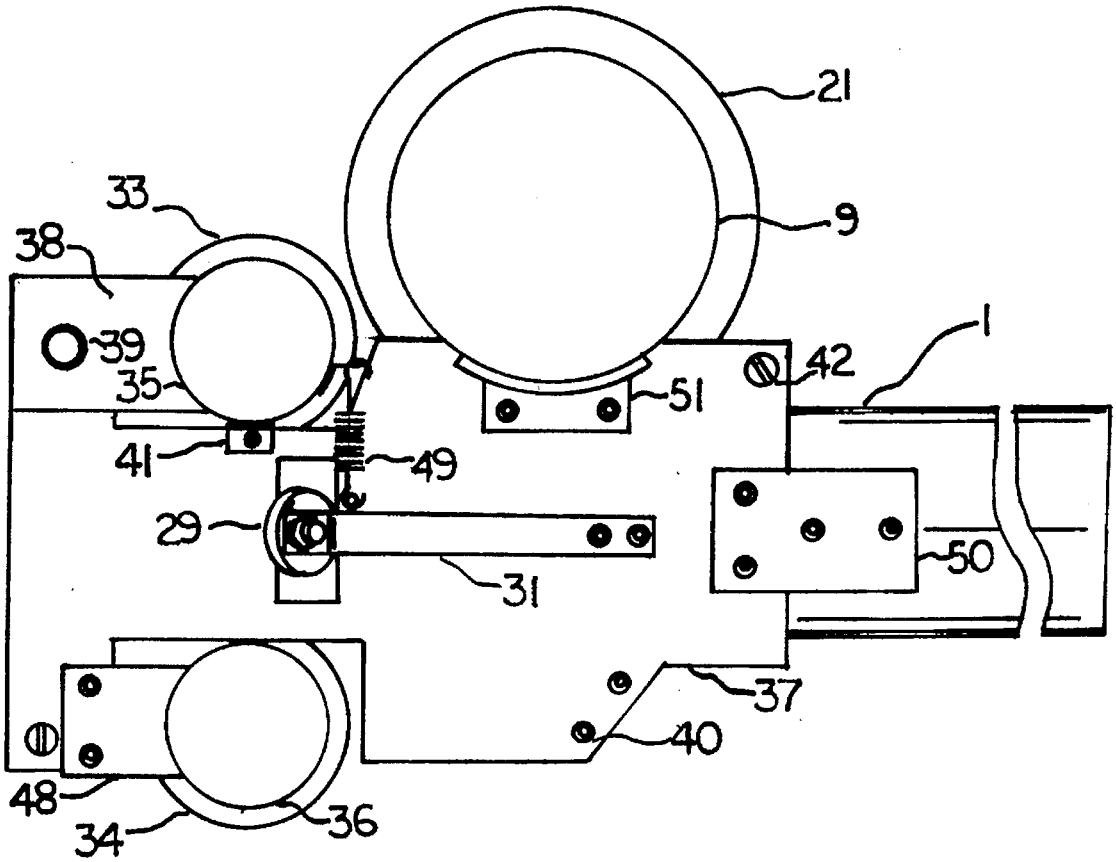
FIG. 6 is a far-side view showing attachment of major components. It is the side which is not shown in FIG. 1.

In FIG. 6, rivets 40 attach tubular entrance port 1 to connector plate 50 and also 50 to primary plate 37. Other rivet-attachments to plate 37 are; thrust motor attachment plate 51, metal strip 31, motor attachment plate 48, motor stopper 41 and clutch plate 22 (see also FIGS. 2, 4). In FIG. 1, stand-offs 43 space plate 12 a distance of a ball diameter from plate 37.

Figure 2:
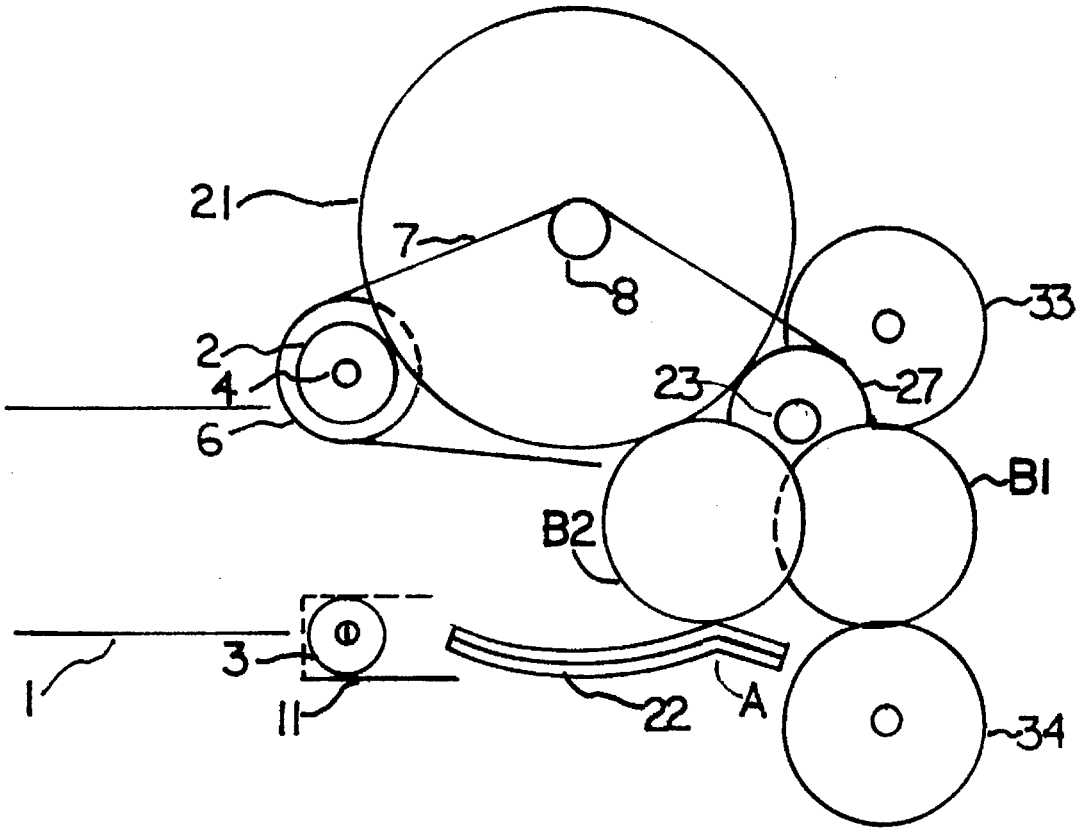
FIG. 2 is a diagram showing the relationship between the path that the ball travels and some components of the apparatus.

Now referring to FIG. 1, when a ball enters entrance port 1 and moves from left to right, it contacts rubber-rimmed wheels 2 and 3 (see also FIG. 2). Wheel 2 is rigidly attached to one end of shaft 4 which is free to rotate in bushing 5 on cover plate 12. The other end of shaft 4 has pulley 6 rigidly attached to it. Rubber belt 7 which is about shaft 8 of variable speed thrust motor 9, pulleys 6 and 27, causes counterclockwise rotation of pulley 6 when motor 9 operates. The ball is engaged by wheel 2 and is clutched between wheels 2 and 3. The ball is therefore carried to the right (see FIG. 2).

Wheel 3 is rigidly attached by way of spacer 10 to one end of lever 11 and does not rotate. Lever 11 is mounted on plate 12 about its pivot 13. The other end of lever 11 has permanent magnet 14 attached. Lever 15 is soft iron and is pivoted about lever 16. Levers 15 and 16 are a tight fit to each other and rotate together. Lever 16 extends down into plate 12 where it is free to rotate. Spring 17 exerts a force on lever 15, trying to pull it away from magnet 14. Spring 18 returns lever 11 to its stop 19. Stop 19 is a cylindrical rubber section attached to plate 12.

The distance between wheels 2 and 3 is such that if a ball travels between them, lever 11 will move as wheel 3 is pushed away from wheel 2. The magnet 14 therefore slides up away from lever 15. As magnet 14 slides up, a point is reached where there is no longer enough magnetic flux to hold lever 15 onto the magnet because the area of the magnet now facing the lever 15 is too small. Lever 15 is therefore released, spring 17 pulls both levers 15 and 16 through a 45 degree angle toward the observer.

When the ball is released by wheel 2, lever 11 returns to its original stop position due to the force of spring 18. Momentum carries the ball further to the right and it contacts rubber-rimmed wheel 21 which engages the ball between itself and rubber covered clutch plate 22 (see FIG. 2). The ball is carried to the right by wheel 21 at a much higher speed than by wheel 2 since they are both rotated by motor 9 and wheel 21 is much larger than wheel 2. When the ball reaches point A (FIG. 2), it can no longer be clutched and is released with a clockwise rotation. Shortly after release, the ball impacts rubber-rimmed cylinder 23. Cylinder 23 is affixed to one end of shaft 24 which runs through lever 26. The other end of shaft 24 has pulley 27 which is rotated by belt 7. It is the upper periphery of the ball that impacts the cylinder 23 and the clockwise rotation on the ball causes the ball to try to move back to the left. The net effect is that the ball is virtually stopped. Cylinder 23 now engages the ball with plate 22, carrying it slowly further to the right.

Figure 3:
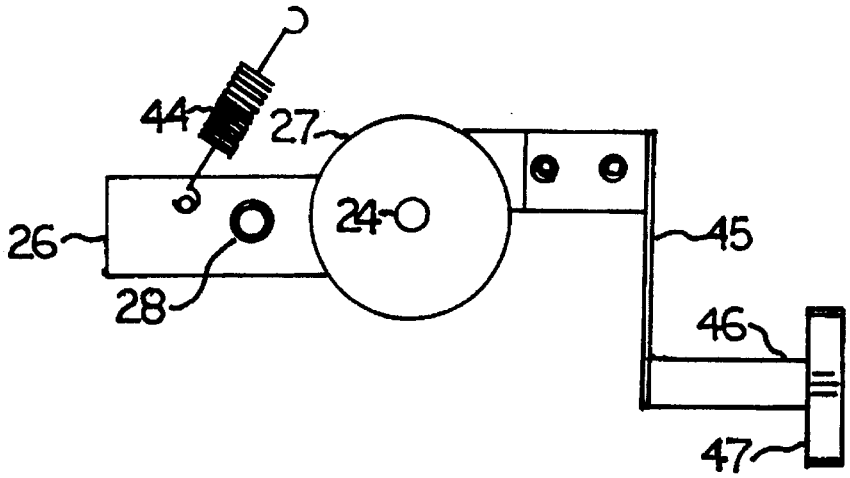
FIG. 3 is a side view of lever 26 showing its attachments more clearly.

Lever 26 is pivoted on plate 12 about 28. The distance between cylinder 23 and clutch plate 22 is such that a ball travelling between them causes cylinder 23 to move away from plate 22. This action causes lever 26 (FIG. 3) to rotate about its pivot 28 carrying wheel 47 toward lever 16. Wheel 47 is attached to springy metal strip 45 through spacer 46. Wheel 47 is free to rotate about its center and when it is carried up by lever 26 it touches lever 16, pushing it back to its original position which it had before wheel 3 was pushed. Lever 15 is therefore returned also and is held by magnet 14.

While the ball was being carried by cylinder 23, it was also acting as a cam on wheels 29, 30. Wheels 29, 30 are mounted at 45 degrees to the non-rivetted ends of springy metal strips 31, 32 (FIGS. 1, 4, 5, 6). When the ball is carried by cylinder 23, it moves wheels 29, 30 apart from each other thereby compressing strips 31, 32. Cylinder 23 can carry the ball over only a small arc of its periphery and so it soon releases the ball to its right. The strips 31, 32 decompress pushing the ball onto wheel 20 which is attached to lever 16 and is rotatable. The ball is now bounded by wheel 20, wheels 29,30 and wheels 34, 35. Wheels 34,35 are rubber-rimmed and rigidly affixed to the shafts of motors 35, 36 which are variable speed electric motors. At this point the ball is in a detented position, wheel 20 and lever 16 serving as a gate that prevents the ball's exit at an inappropriate time.

In the detented position, the ball can be rotated clockwise or counterclockwise by alternately turning on either motor 36 or 35 respectively. The amount of spin on the ball therefore depends on the speed of motors 35, 36. If neither motor is on, there is no spin on the ball.

Referring now to FIG. 2, let the first ball that entered the system be called B1. When a second ball B2 enters entrance port 1, it again causes lever 16 to turn through 45 degrees toward the observer. It is then carried by wheel 21 at high speed and encounters ball B1 which is detented to protrude into space required by B2 as it travels toward point A. The resulting impact ejects B1 from the system. B1 carries the spin imparted by wheel 33 or 34 at the time of impact. B2 is now becomes detented. The third ball entering the system will therefore eject B2, the fourth ball will eject the third and so on.

When balls are ejected consecutively without spin, they fall within close proximity of each other. However, when there is top-spin, they fall slightly shorter because the rotation causes the ball to dip sooner. The converse is true in the case of under-spin. These phenomena do not significantly alter the distance successive balls are thrown and in practice the maximum alteration is in the order of five percent of the set distance. However, a circuit in the electrical control and power supply unit corrects for these phenomena. This will become apparent in the following description of the electrical system of the apparatus.

Figure 7:
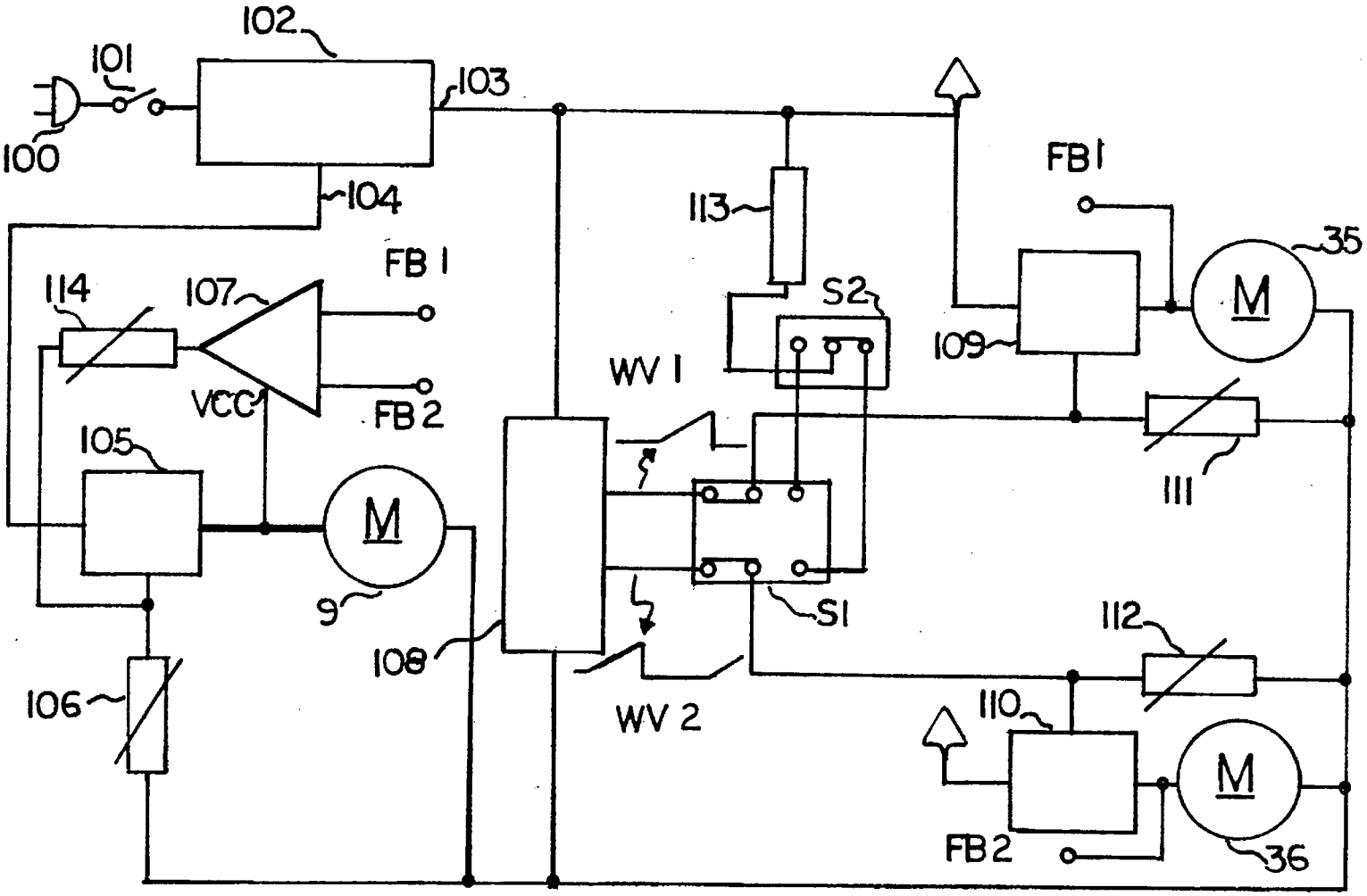
FIG. 7 is a block diagram of the electrical power supply and control. Some actual electrical components have been shown for clarity.

FIG. 7 is a block diagram of the electrical power supply and control. In FIG. 7 it can be seen that electrical power from the commercial supply enters through plug 100. Switch 101 turns power on or off to Direct Current (DC) power supply 102. DC supply 102 has 12 volt outputs at 103 and 104. Output 104 goes to the power input of variable voltage regulator 105. The power output of regulator 105 is connected directly to thrust motor 9. This output also supplies power to feedback amplifier 107 at VCC. Variable resistor 106 adjusts the output voltage across motor 9 and is the primary speed control for ejecting balls from the apparatus.

The rest of the circuit is supplied power from 103 of DC supply 102. Waveform generator 108 produces ramp waveforms WV1 and WV2 which are supplied to separate contacts of slide switch S1. The common contacts of S1 are connected to the control electrodes of variable voltage regulators 109, 110. Regulators 109, 110 are supplied 12 volts at their power inputs by 103 of DC supply 102 and their power outputs are connected to motors 35, 36 respectively. Variable resistors 111, 112 are connected to the control electrodes of regulators 109, 110 respectively and contol the speed of rotation of the motors 35, 36.

The condition of S1 in the diagram, allows ramp waveforms WV1, WV2 to turn on motors 35, 36 alternately, depending on the phase of these waveforms. Only one motor can be turned on at any given time. In this S1 position the spin on each ball is automatically reversed and changed in magnitude at random due to the ramp waveforms turning on the motors 35,36 alternately. In the other position of S1, the third pair of contacts are connected to the the control electrodes of regulators 109, 110 and WV1, WV2 no longer control the speed and direction of motors 35, 36. The third pair of contacts on S1 are also connected to separate contacts on S2. S2 has only three contacts. It has a common and two other contacts. The common contact is connected to fixed resistor 113 which has its other end connected to 103. S2 is therefore used to switch a positive voltage to either control electrode of regulators 109, 110. This positive voltage enables the operation of motor 35 or 36, depending on the contact of S2 that is connected to its common contact. S2 is therefore a manual control for turning on spin motors 35, 36.

The output of feedback amplifier 107 is connected to the control electrode of regulator 105 through trim variable resistor 114. Feedback amplifier 107 has the output voltage of regulators 109, 110 going to its inputs at FB1, FB2. Since the speed of motors 35, 36 is proportional to the voltage supplied to them, then FB1, FB2, have a voltage that is representative of the speed of these two motors. Any change in the output of amplifier 107 affects the output of regulator 105 and hence the speed of motor 9. When motor 35 is operating, motor 9 is made to rotate more slowly and when motor 36 is operating, motor 9 is made to rotate faster thereby compensating for the earlier mentioned phenomena concerning the distance the ball is thrown. It should be noted that amplifier 107 is supplied power from the output of regulator 105. This allows its compensating range to track the speed of the ejected ball. Higher ejecting speeds require more compensation. Lower ejecting speeds require less compensation. Variable resistor 114 sets an optimum working point for the feedback amplifier and hence optimizes the feedback operation over the entire speed range of motor 9.

What is claimed is:

1. A single entrance and single exit table tennis ball projecting apparatus capable of reversing the direction of spin it imparts to successively ejected balls in less than one second, comprising;

(a) a variable speed electric motor attached to a primary mounting plate in a manner that allows a thrust wheel rigidly attached to the shaft of said motor to be concentrically adjacent to an arc clutch plate which is itself attached to said primary plate so that its entire concentric length is a distance slightly less than a ball's diameter away from the periphery of the thrust wheel;

(b) a secondary plate mounted with a side parallel to one side of the primary plate, thereby forming a channel the size of the ball between the periphery of the thrust wheel, the arc clutch plate, the primary and the secondary plates;

(c) a rotatable rubber-rimmed wheel rigidly attached to one end of a shaft running perpendicularly through a bushing in said secondary plate;

(d) a first lever, pivoted near its center by a shaft which is affixed perpendicularly into the secondary plate; said first lever having a non-rotating rubber-rimmed wheel attached to one end so that the peripheries of the rotating and non-rotating rubber-rimmed wheels form a gap through which the ball can be carried if engaged by the rotating rubber-rimmed wheel; said first lever having a magnet attached to its other end;

(e) a soft iron lever rigidly attached at one end to a cylindrical third lever which is rotatable in a bore of a ninety degree angled section of the secondary plate, so that the axis of the third lever is in a plane parallel to the side of the primary plate; said soft iron lever and third lever being rotatable together; said third lever being bent at ninety degrees near its unattached end;

(f) a fourth lever pivoted near its center about a shaft affixed perpendicularly onto the secondary plate; said fourth lever being pulled to a stopper at one end by a spring, its other end having a rotatable shaft fitted into it; said shaft having a rubber-rimmed cylinder rigidly attached to one end; said cylinder being in a position to stop any ball thrown by the thrust wheel; said fourth lever also having a rotatable wheel attached to one end;

(g) two similar springy metal strips, one attached at one end to the primary plate the other attached at one end to the secondary plate; said metal strips being bent at their unattached ends so that a rotatable wheel attached to each unattached end has its axis oriented forty-five degrees to the primary plate; said wheels being positioned a distance slightly less than a ball's diameter from each other at their peripheries;

(h) two smaller motors with a rubber-rimmed wheel rigidly attached to each shaft; said smaller motors being attached to the primary plate in a way that allows said wheels on smaller motors to have their peripheries spaced a distance slightly less than a ball's diameter from each other; said wheels on smaller motors being part of a detent for the ball, the rest of the detent being the wheels on the springy metal strips mentioned in (g) of this claim.

2. A table tennis ball projecting apparatus as in claim 1 wherein a ball entering between the rotating rubber-rimmed wheel on the secondary plate and the non-rotating rubber wheel on the first lever pushes the first lever thereby moving the magnet attached to the other end of said first lever partially away from a soft iron lever; said soft iron lever then being pulled away from the magnet by a spring, thereby causing a third lever which is bent, to turn away from blocking the ball's exit; said ball being released by the rotating rubber-rimmed wheel is engaged by the rotating thrust wheel, pressed onto the arc cluth plate and carried to the end of cocentricity of the arc where it is again released then stopped by the rubber-rimmed cylinder; said cylinder rotating to carry the ball between itself and a non-concentric extension of the arc clutch plate, while simultaneously parting two wheels mentioned in (g) of claim 1 and being itself pushed away from the arc extension, thereby causing the forth lever to carry the wheel attached to its end; said wheel attached to fourth lever-end pushing bent section of the third lever back to its original position of blocking the ball's exit; said ball being released by the cylinder, is pushed by the decompression of the strips and wheels in (g) of claim 1; said ball being detented between said strips and wheels and the two wheels on the smaller motors mentioned in (h) of claim 1; said ball being ejected from the apparatus when a second ball enters and is carried by the thrust wheel to impact said detented ball; said ball being ejected carrying any spin imparted by either rotating wheel on the smaller motors.

* * * * *